US005788129A

United States Patent [19]

Markos

[11] Patent Number: 5,788,129

[45] Date of Patent: Aug. 4, 1998

[54] SPRAY TUBE ATTACHMENT, STORAGE AND CONNECTING DEVICE FOR AEROSOL CANS AND LIKE CONTAINERS

[76] Inventor: Charles J. Markos, 1069 Club Pl., NE., Atlanta, Ga. 30319

[21] Appl. No.: 727,999

[22] Filed: Oct. 10, 1996

[51] Int. Cl.[6] ..... B05B 15/06; B65D 83/14

[52] U.S. Cl. ..... 222/538; 222/543

[58] Field of Search ..... 222/526, 530, 222/533, 538, 543; 239/337, 588, 587.1

[56] References Cited

U.S. PATENT DOCUMENTS

| | | | |
|---|---|---|---|
| 3,282,476 | 11/1966 | Tracy | 222/543 X |
| 4,819,838 | 4/1989 | Hart, Jr. | 222/538 |
| 4,823,445 | 4/1989 | Diener | 222/538 X |
| 4,858,792 | 8/1989 | De Laforcade | 222/538 X |
| 5,058,783 | 10/1991 | Antonelli | 222/543 X |
| 5,143,263 | 9/1992 | Newell | 222/538 |
| 5,178,354 | 1/1993 | Engvall | 222/538 X |
| 5,297,704 | 3/1994 | Stollmeyer | 222/543 X |
| 5,529,226 | 6/1996 | Alberth, Jr. | 222/543 X |

FOREIGN PATENT DOCUMENTS

| | | | |
|---|---|---|---|
| 2381683 | 9/1978 | France | 222/538 |
| 3937278 | 5/1991 | Germany | 222/538 |

*Primary Examiner*—Kevin P. Shaver
*Attorney, Agent, or Firm*—Jones & Askew, LLP

[57] ABSTRACT

The present invention comprises an improved mechanism that permanently attaches a spray tube to an aerosol spray can, stores the spray tube conveniently and effectively when not in use, provides a user the opportunity to use or not to use the spray tube, and positively prevents loss of the spray tube. Further, the improved mechanism is constructed without extraneous materials or extensions.

15 Claims, 2 Drawing Sheets

SPRAY TUBE ATTACHMENT, STORAGE AND CONNECTING DEVICE FOR AEROSOL CANS AND LIKE CONTAINERS

FIELD OF THE INVENTION

This invention relates in general to aerosol spray cans provided with a spray tube. More particularly, this invention relates to an improved mechanism that permanently attaches a spray tube to an aerosol spray can, stores the spray tube conveniently and effectively when not in use, provides a user the opportunity to use or not to use the spray tube, and positively prevents loss of the spray tube. Further, the improved mechanism is constructed without extraneous materials or extensions.

BACKGROUND OF THE INVENTION

Aerosol spray cans are commonly used for discharging a wide variety of fluids. While some applications require a broad spray pattern for the fluid, many times an accurate, narrow stream of fluid is needed.

A small elongated spray tube is often provided with an aerosol spray can to assist in such applications. The tube is sized to be used in conjunction with a nozzle through which the fluid is dispersed. The tubes may vary in length, but are typically slightly shorter than the height of the can. The tubes are commonly made of a flexible plastic material and are inserted into the nozzle of the aerosol can for use. In order to obtain a narrow stream of fluid from the aerosol can, the tube is removed from its stored position on the can and one end is inserted into the nozzle for in-line guided discharge of the fluid. Upon completion of the task, the tube is preferably removed from the nozzle and again stored on the side of the aerosol can.

Spray tubes are conventionally provided to end users in any one of many ways. For example, tubes may be provided "loose" or separate and apart from the can. As a further example, the tubes are often removably attached to the side of the aerosol can by means of adhesive tape or a rubber band. Unfortunately, reattachment of the spray tube to the aerosol can becomes impaired if the tape is no longer adhesive or the rubber band is either lost or broken. In those instances, the spray tube will likely be either lost or thrown away. Furthermore, the spray tube itself may be lost during or after use. In such an event, the benefit obtained by the tube is lost entirely.

In recognition of these problems, various devices have been proposed. Specifically, applicant directs attention to U.S. Pat. Nos. 4,805,814; 4,819,838; 4,823,445; 4,858,792; 4,941,594; 5,058,783; and 5,143,263. By way of example, U.S. Pat. No. 5,058,783 is directed to a Spray Tube Support Assembly that retains the spray tube adjacent to the container. A primary element of the device is a connector cord that extends between a supporting block attached to the can and a holder about the spray tube. In another embodiment, U.S. Pat. No. 5,058,783 describes and shows a block that is seated on a raised rim of the aerosol spray can. In this embodiment, the block can be removed from the can or moved around the periphery of the can.

As a further example, U.S. Pat. No. 4,819,838 discloses a support rig that, in conjunction with support tabs, retains the spray tube along the side of the aerosol can. In an alternative embodiment, U.S. Pat. No. 4,819,838 discloses a clamp that utilizes friction to retain the spray tube.

As a yet further example, U.S. Pat. No. 4,858,792 discloses a spray tube and dispensing head that is mounted onto the top of the spray can and communicates with the nozzle conduit to dispense the fluid. At rest, the device retains the spray tube portion along the side of the aerosol can. The spray tube can be pivoted into an operative position for operative use, but offers a user only one choice of a spray pattern.

As a yet further example, U.S. Pat. No. 4,941,594 discloses a dispensing tube and cap holder for use in combination with an aerosol can and a dispensing tube. The device includes attachment mechanisms at the top and bottom of the device to facilitate attachment to the can. U.S. Pat. No. 4,941,594 also describes a device that is mounted on the sidewall of the can by spot welds or an adhesive.

The devices shown in these patents all, generally speaking, accomplish the result of retaining the spray tube to the aerosol spray can. Even so, various difficulties remain. In some cases, difficulties are created. For example, a connector cord or the like will form a loop when the spray tube is stored in the mounting block (the at-rest position), and will provide a conspicuous protrusion from the aerosol can wall. In use, a connector cord (or the like which is protruding thusly) is susceptible to damage from snagging or may be otherwise broken. Further, such an arrangement provides unique challenges in terms of manufacturing, production cost, shipping and handling. The connector cord and supporting block must be attached to the can. In high-speed manufacturing processes, the presence of a loop that does not lay flat against the wall of the aerosol can is particularly difficult.

Several of these patents show use of an adhesive to secure the spray tube by use of another member that, in turn, supports the spray tube. The use of an adhesive is of considerable concern. Many spray tubes are utilized with petroleum distillate based products such as that known by the trade name "W-D 40." It is not uncommon for the product to be dispensed to bleed onto the can and, as a result, any adhesive that secures a spray tube to the sidewall of the can may become affected, thereby rendering it difficult to retain a support element to the sidewall of the can. Further, the placement of a block or like supporting element onto the sidewall of the can (using either an adhesive or spot weld) will cover up a portion of the can's trade dress. Given the relatively small size of these cans, the space available for such critical use of the trade dress is of the utmost importance. Many items, such as directions for use, trademarks, logos, industrial designs and such, have been prepared at great care and expense to have an effect on the prospective or actual purchaser. Such items would be compromised by the fixed presence of the supporting element against the sidewall of the container which also may well detract from the visual presentation thereof.

Yet another consideration is the position of the spray tube when not being used. Certain of the above-referenced devices provide for the spray tube to be loosely held to the can but not permanently attached thereto. With such a configuration, the spray tube could easily be dislodged and lost if the aerosol can is turned over or knocked from its upright position.

Yet other devices, some of which are not shown by the referenced patents, are known to provide a specially configured cap that retains the spray tube in a substantially horizontal position when not being used. In such cases, the cap is mounted on the top inner rim of the aerosol can with the spray tube typically being held by friction in a conforming notch in the cap. Mounted in this fashion, both ends of the spray tube extend beyond the edge of the cap, with the length of the tube approximating the diameter of the can. The exposed ends cause the spray tube to be susceptible to being dislodged from the cap and thus lost. Such loss could occur during handling by either the retailer or the final consumer. Furthermore, if the cap itself is lost, the tube may be lost with it, or have no place to be stored after use, thus contributing to its eventual loss.

As noted above, positioning the spray tube in this fashion limits its length to the diameter of the aerosol can, since a tube extending beyond the can's edge would interfere with factory bulk packaging, retail display and ultimate consumer storage. This length-limiting condition also significantly impedes the effectiveness of the spray tube. In many cases, the discharging end of the spray tub must be manipulated around the outer portions of a device needing, say, lubrication, and be positioned directly at the specific inner portions of the device where such lubrication is required. A short tube limits how closely the discharging end of the spray tube may be placed to the target area, thus limiting the precision with which the contents of the aerosol can be delivered. The fundamental utility of the spray tube is, therefore, diminished.

Other of the above-referenced devices, such as that shown in U.S. Pat. No. 5,058,783, provide for the spray tube to be attached to a connector cord, which either forms a loop if the spray tube is secured in a mounting block, or in another configuration dangles freely from a fixed position with the spray tube on its end. Both of these embodiments provide the ready opportunity for the devices to become tangled during manufacturing, shipment, retail handling and final consumer use. To untangle such intertwined connector cords and spray tubes would be inconvenient, time-consuming and frustrating. Furthermore, these embodiments are susceptible to snagging and breaking, in which case all of the foregoing concerns are immediately recognized, as well as the additional concern of the spray tube being lost as a result.

In yet another device, which mounts a dispensing tube and cap holder on the sidewall of an aerosol can, the preferred embodiment includes a top and bottom flange by which said device is attached to the can. The device is longer than the sidewall of the can, with the bottom flange extending beyond the can's bottom rim and then being conformed around said rim. In conjunction with a similarly styled and conformed top flange mounted on the can's top rim, the device is attached to the can. This configuration, however, causes the aerosol can to stand at an angle rather than perpendicularly to a horizontal surface such as a shelf, since the bottom flange forms a protrusion which precludes stable, complete contact of the can bottom with a shelf or other resting surface. This misaligned, unstable stance creates obvious difficulties for packaging, retail display and consumer storage. In addition, the tube is not permanently attached to the can during use, thus exposing the tube to loss by being inadvertently dislodged from the nozzle and falling into an inaccessible place.

An alternative embodiment of this device uses spot welds or adhesive to replace the flanges as attachment mechanisms. The limitations of adhesives have been previously discussed above. The limitations of spot welds involve many of these same limitations, as well as the additional manufacturing complexity and cost. These factors are critical considerations in relation to the relatively nominal retail sales prices of the products with which the device will be used.

In view thereof, there is a need in the art for an improved device that fixedly secures a full-size spray tube to an aerosol can, stores the tube firmly and unobtrusively to the can, positively connects the tube to the can during use, and positively prevents loss of the tube during both use and storage. Further, there is a need in the art for an attachment, storage and connecting device that addresses the manufacturing, packaging, retail and consumer realities associated with the handling and use of such devices, including reduction of production costs, easy and convenient handling, and efficient and effective operation of the device. Lastly, there is a need in the art for an improved device which, to the inventor's knowledge, conveys no disadvantages or detractions from the advantages of the present invention as described below.

SUMMARY OF THE INVENTION

The present invention solves the above-described problems in the prior art by providing an improved attachment, storage and connecting device for a spray tube associated with an aerosol spray can. A preferred embodiment of the invention is positively secured to an upper rim of a conventional aerosol can and stores the spray tube in a position substantially along the sidewall of the can. The invention preferably provides a molded, integral unit that works efficiently to guard against inadvertent dislodging of the tube from its at-rest position and, in the event of any such dislodgment, continues to maintain the spray tube in a fixed position along the sidewall of the can. Further, the invention is readily attached (snapped on) to the aerosol can. The invention further provides that the device may be moved around the periphery of the can so that the indicia and markings on the can, such as trade dress materials and directions for use, are not covered and are readily viewed. Further, the device provides a highly streamlined and efficient design that is easily manufactured, and addresses and solves many of the difficulties associated with other known devices.

Generally described, the present invention comprises an improved device for a spray tube to be attached to an aerosol-type spray can. The device is preferably permanently attached to the upper rim of the spray can in such a manner as to permit it to be slid around the periphery of the can rim. Thus, although permanently attached, the device does not permanently obscure any portion of the aerosol can's labeling. The device furthermore enables the user to pivot the spray tube from an initial at-rest storage position that is substantially parallel and adjacent to the spray can sidewall, into an operative position for providing a narrow accurate stream of fluid. The spray tube may then be replaced into the initial storage position, parallel to the wall of the can, again without fear of losing the spray tube. At all times when in the at-rest and operative positions, the spray tube is positively attached to the aerosol can, thus precluding loss from being inadvertently dislodged at any time.

Accordingly, it is an object of the present invention to provide an improved attachment, storage and connecting device for a spray tube used with aerosol-type spray cans.

Another object of the present invention is to provide an improved attachment, storage and connecting device for a spray tube that can be conveniently and permanently attached to the top rim of the spray can.

Still another object of the present invention is to provide an improved attachment, storage and connecting device for a spray tube that will prevent the loss of the spray tube.

A further object of the present invention is to provide an improved attachment, storage and connecting device for a spray tube that can be moved around the rim of the can so that the inscriptions on the can are not permanently obscured.

Yet another object of the present invention is to provide an improved attachment, storage and connecting device that provides for convenient and immediate use with a spray can.

Yet another object of the present invention is to provide an improved attachment, storage and connecting device that is easily manufactured.

Yet another object of the present invention is to provide an improved attachment, storage and connecting device that can be manufactured economically in relation to the anticipated relatively nominal retail sales price of the product with which the improved device is to be used (i.e., the aerosol can and its contents).

Yet another object of the present invention is to provide an improved attachment, storage and connecting device that during packaging at the factory utilizes only the available space between cans, and thus does not require modifications to the shipping cartons currently in use.

Yet another object of the present invention is to provide an improved attachment, storage and connecting device that is readily handled by retailers and others who receive, stock and sell multiple spray cans fitted with the present invention.

Yet another object of the present invention is to provide an improved attachment, storage and connecting device that can be economically and efficiently manufactured as a single unit or with a minimal number of component parts and resulting assembly.

Yet another object of the present invention is to provide an improved attachment, storage and connecting device which can be mounted flush against the can wall and can store the spray tube in essentially the same manner, flush against the can wall.

Yet another object of the present invention is to provide a improved attachment, storage and connecting device including a flexible extension member which provides a hinge-like action upon activation.

These and other objects, features and advantages will become apparent from a review of the following detailed description of the invention and the appended drawings and claims.

DETAILED DESCRIPTION

Figure 1:
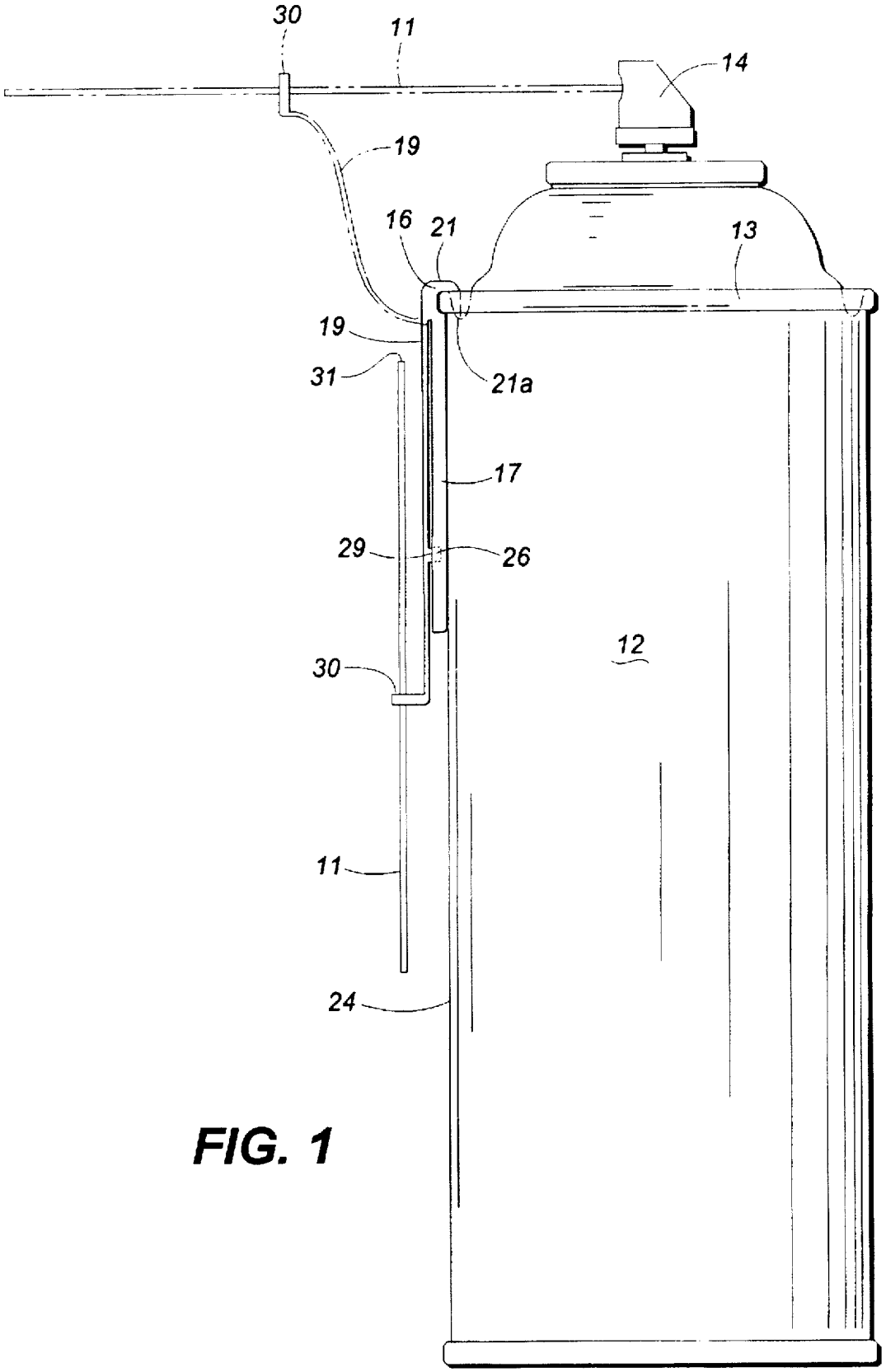
FIG. 1 is a side view of a preferred embodiment of the present invention as used with an aerosol can, showing both an initial storage position and an operative position (in phantom).
Figure 2:
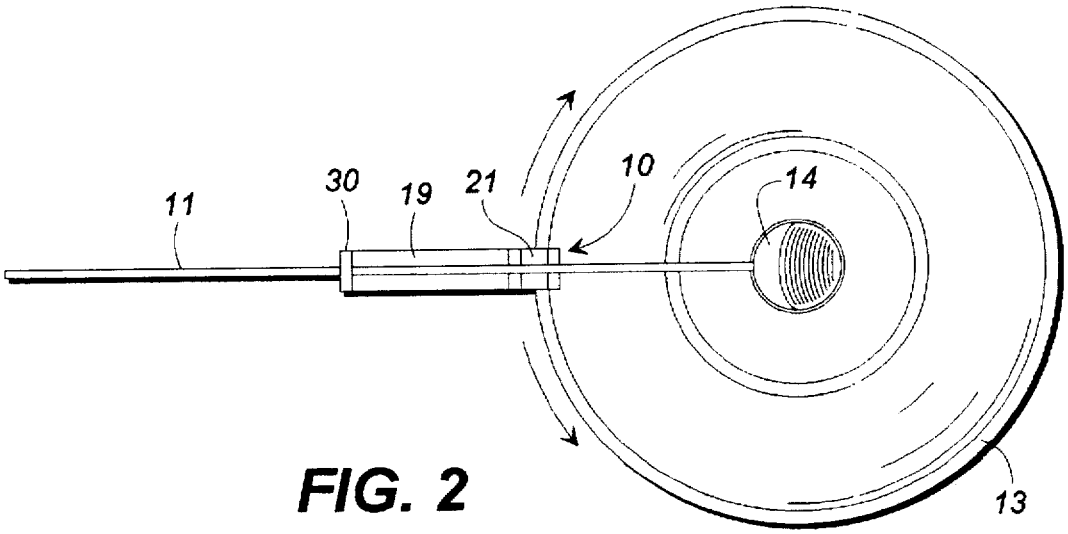
FIG. 2 is a top view of the present invention showing the spray tube in the operative position.
Figure 3:
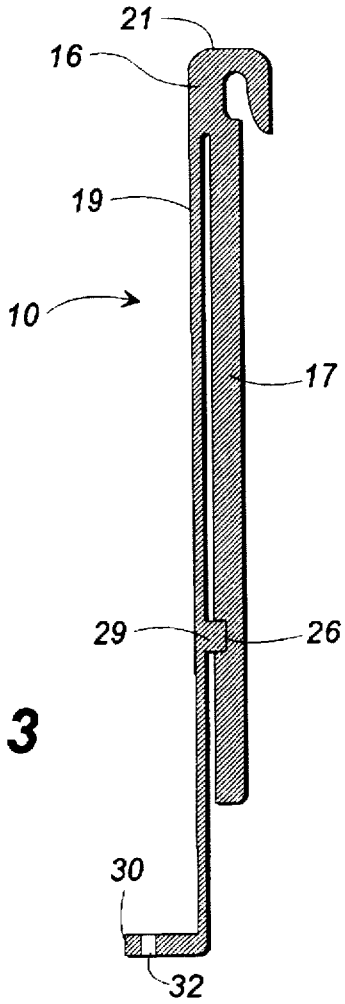
FIG. 3 is a cross section, partial view of the present invention illustrating the manner in which the device is molded and fitted onto the top outside rim of an aerosol can.

Referring now to the drawings, in which like numbers indicate like elements through the several views, the invention comprises an improved attachment, storage and connecting device 10 designed to hold and operatively engage a spray tube 11 used with an aerosol can 12 having a top outside rim 13 and a nozzle 14. The device 10 comprises a retainer 16, a stabilizer bar 17 and an extension arm 19, all molded integrally at one end to define a top portion 21. The device 10 further includes end tab 30 through which the spray tube 11 passes. As described below, the device 10, including spray tube 11, is secured so as to be permanently yet slideably attached to said aerosol can 12.

The retainer 16 ensures permanent attachment of the device 10 and the spray tube 11 to the aerosol can 12. The device 10 is preferably made of plastic, sheet metal or any other suitable material. The device 10 may be of varying widths, although a preferred width is approximately one quarter (0.25) to one-half (0.5) inches. The device 10 may be relatively thin, only of sufficient dimension to allow retainer 16 to be effectively attached to top outside rim 13 of the can 12 as described below. The retainer 16 is formed or configured to be hooked or captured by the entire cross section surface of outside top rim 13 of the aerosol can 12. Described more particularly, the top portion 21 of the retainer 16 defines an inner surface 21*a* on the lower side thereof. In combination, inner surface 21*a* conforms to the top outside rim 13. In so doing, these two elements provide a secure fit and ensure that the spray tube attachment, storage and connecting device 10 is attached permanently to aerosol can 12. As described in greater detail hereinbelow, the retainer 16 is formed integrally with the top portion of extension arm 19. Said extension arm 19, through its suitably flexible construction, bends as necessary to facilitate association of the spray tube 11 to the nozzle 14.

The spray tube 11 is conventional in design and use. One of ordinary skill in the art will appreciate that the spray tube 11 may be formed integrally with end tab 30 and extension arm 19 as described in greater detail below.

The stabilizer bar 17 is configured to rest flush against the curved can wall 24 of the aerosol can 12, and is molded or formed with adequate rigidity to provide for proper functioning of the invention. Once the spray tube attachment, storage and connecting device 10 is fixed about the top outside rim 13 of the aerosol can 12, the stabilizer bar 17 rests flush and rigid against the can wall 24 of the can 12. The retainer's top portion 21 is secured to the top outside rim 13 of the can including the underside of the rim 13. This arrangement ensures that the device 10 is permanently attached to the can 12, but also permits the device 10 to be slid to various locations around the top outside rim 13 of can 12, if desired. The top of the stabilizer bar 17 is formed integrally with the top of the extension arm 19 and the bottom of retainer 16. In the preferred embodiment, the top surface 21 connects to the top portion of extension arm 19 which, through its suitably flexible construction, also effectively operates as a hinge which permits the extension arm 19 to be pivoted above the top outside rim 13 of the can 12. Those of ordinary skill in the art will appreciate that the extension arm 19 may be joined to the stabilizer bar 17 at other locations and still achieve the flexible hinging action as described above. This pivoting action permits use of the spray tube 11 as described in greater detail below.

The stabilizer bar 17 defines an indentation 26 on its outward surface (facing extension arm 19). The indentation 26 is sized to receive a protrusion 29 located on the back side (toward the can 12) of the extension arm 19. The protrusion 29 and indentation 26 create a male/female connection that secures the extension arm 19 into a position substantially parallel to the can wall 24 for storage of the spray tube 11. The extension arm 19 further includes an end tab 30 that protrudes from the extension arm 19 perpendicularly away from the can wall 24. The end tab 30 and the bottom portion of extension arm 19 are preferably formed of a somewhat greater thickness in order to ensure sufficient rigidity to support the tube 11. The end tab 30 can be formed with an aperture 32 for receipt of the spray tube 11. Alternatively, as stated hereinabove, the spray tube 11 can be formed integrally with the end tab 30.

In the initial, at-rest position, the spray tube 11 is suspended by the spray tube attachment, storage and connecting device 10 in a plane substantially parallel to the can wall 24 of the aerosol can 12. More particularly, the spray tube 11 is formed integrally with or inserted in aperture 32 of the end tab 30 as shown in FIG. 1, and may be positioned vertically either up or down in relation to the end tab 30 in order to locate the tube as desired. The extension arm 19 is then pressed toward the can wall 24 of the aerosol can 12 until it engages the stabilizer bar 17. This, in turn, causes the protrusion 29 to engage the indentation 26 and causes the extension arm 19 to be connected to the stabilizer bar 17. As a result, the spray tube 11 is stored flush against can wall 24 as shown in FIG. 1.

In use, the extension arm 19 is activated by disengaging protrusion 29 from indentation 26. The extension arm 19, which is molded as thinly as necessary for appropriate flexibility, is lifted and manipulated so as to place top end 31 of the spray tube 11 into the nozzle 14 of the can 12, shown in phantom in FIG. 1. The spray tube 11 is thus in position to provide an accurate narrow stream of fluid upon activation of the nozzle 14. Upon completion of the desired task, the top end 31 of the spray tube 11 is removed from the nozzle 14 and the extension arm 19 is returned into engagement with the stabilizer bar 17 by re-engaging protrusion 29 and indentation 26. The spray tube 11 is again stored firmly, sleekly and unobtrusively along can wall 24 of the can 12 for further use.

Thus, it will be appreciated by one of ordinary skill in the art that the above-described preferred embodiments of the present invention fulfill the needs in the prior art. The invention is readily manufactured as a single unit, including the potential for forming the spray tube integrally with the attachment, storage and connecting device. As a result, the device can be economically and efficiently made. The improved device of the present invention is readily secured to a conventional aerosol can and, since when once secured it can still be moved about the periphery thereof, it does not permanently obscure any trade dress, instructions, or like inscriptions on the sidewall of the can. Further, because the device is so sleekly and unobtrusively mounted along the can wall, it can be arranged for packing and unpacking so as to ensure against damage and inconvenience. Further, should the stabilizer bar 17 inadvertently become disengaged from the extension arm 19, the spray tube 11 will nonetheless be retained in a substantially parallel plane to the can wall 24 of the can 12. This arrangement will guard against loss or damage to the spray tube even in the event of such inadvertent dislodgment during shipment or otherwise. The retailer will thus be able to readily remove an aerosol can fitted with the present invention from a box or other package, and place the can on a store shelf for sale without special handling or additional attention. The present invention will also diminish retailers' concerns of spray tube loss due to pilferage or failure of conventional attachment devices utilizing adhesive tape or rubber bands. Further, a user of the device will find it to be both convenient and efficient. In the initial storage, at-rest position, the spray tube 11 is typically maintained below the top outside rim 13 of aerosol can 12. Thus, the nozzle 14 may be activated without intrusion of the device or the tube in those cases where the user desires a broad spray instead of a narrow spray. Moreover, as the extension arm 19, by means of end tab 30, is integrally molded with or attached to the spray tube 11, it will preclude loss or misplacement of the tube 11.

Those of ordinary skill in the art will appreciate that known aerosol cans are provided with different types of caps, some of which extend over the top outside rim 13. In such an event, it will be understood that the aerosol can cap may be provided with a slot or other modification, if necessary, in order to accommodate the present invention.

Thus, it is seen that a device embodying the present invention enjoys particular advantages over prior art devices in terms of manufacturing ease and efficiency, production cost, retail handling and end user operation. Furthermore, the device creates no disadvantages for any of the advantages it conveys. While this invention has been described in detail with particular reference to preferred embodiments thereof, it will be further understood that variations and modifications can be effected within the spirit and scope of the invention as described hereinbefore and as defined in the appended claims.

What is claimed is:

1. An attachment, storage and connecting device for a spray tube for use with an aerosol spray can, comprising;

a means for permanently attaching an elongated spray tube to an aerosol can, said means including an extension member that permits storage of said elongated spray tube in a position approximately parallel to a sidewall of said aerosol can, and is sufficiently flexible as to be readily moved about a particular point in order to bring said spray tube into a operative position with said spray nozzle of said aerosol can.

2. An attachment, storage and connecting device for a spray tube for use with an aerosol spray can, comprising;

an elongated spray tube configured for use with a spray nozzle of an aerosol can, said can defining an upper rim;

a means for permanently attaching said spray tube to said aerosol can, said means including an extension member that permits storage of said elongated spray tube in a position approximately parallel to a sidewall of said aerosol can, and is sufficiently flexible as to be readily moved about a particular point in order to bring said spray tube into a operative position with said spray nozzle of said aerosol can.

3. The device of claim 2 wherein said means includes a stabilizer member that sits substantially flush against said sidewall of said aerosol can to provide support for said extension member while said extension member stores said spray tube.

4. The device of claim 3 wherein said stabilizer member is of sufficient rigidity to maintain its position relative to said sidewall of said can during activation of said extension member.

5. The device of claim 3 wherein said extension member and said stabilizer member include means for securing the position of said extension member to store said spray tube.

6. The device of Claim 5 wherein said securing means comprises a protrusion provided on one or the other of said extension member and said stabilizer member, and an opposed corresponding receptacle provided on one or the other of said extension member and said stabilizer member, whereby upon engagement of said protrusion and receptacle, said spray tube is maintained in a position approximately parallel to said sidewall of said aerosol can.

7. The device of claim 5 wherein said securing means comprises a friction fit between said extension member and said stabilizer member.

8. The device of claim 2 wherein said extension member includes a tab for receipt of said elongated spray tube.

9. The device of claim 8 wherein said tab is positioned substantially near the bottom end of said extension member.

10. The device of claim 8 wherein said elongated spray tube is formed integrally with said tab.

11. The device of Claim 8 wherein said tab is provided with an aperture for receipt of said spray tube.

12. The device of claim 2 wherein said means for permanently attaching said spray tube for said aerosol can includes a portion configured to conform to the outside top rim of said aerosol can.

13. An attachment, storage and connecting device for a spray tube for use with an aerosol spray can, comprising;

an elongated spray tube configured for use with a spray nozzle of an aerosol can, said can defining an upper rim;

means for permanently and slidably attaching said elongated spray tube to said aerosol can, said device further comprising;

means for securing said device to the top outside rim of said aerosol can, a support member formed integrally with said securing means and of sufficient rigidity to be mounted approximately parallel to and approximately flush against the sidewall of said aerosol can, and a flexible member formed integrally with said securing means, said flexible member being capable of sustaining a first position approximately parallel to said sidewall of said aerosol can and, upon association of said spray tube with said flexible member, capable of being maneuvered to a second position operative with said spray nozzle, all while continuing to permanently attach said spray tube to said aerosol can.

14. The device of claim 13 wherein said flexible member comprises an extension member including means for connecting said extension member to said support member so as to deter separation one from the other.

15. The device of claim 13 wherein said extension member securing means includes an indentation defined in said support member adapted to receive a protrusion defined in said extension member.

* * * * *